US009419345B2

(12) United States Patent
Yun et al.

(10) Patent No.: US 9,419,345 B2
(45) Date of Patent: Aug. 16, 2016

(54) DUAL REFLECTOR ANTENNA WITH HYBRID SUBREFLECTOR

(71) Applicant: Electronics and Telecommunications Research Institute, Daejeon (KR)

(72) Inventors: So Hyeun Yun, Daejeon (KR); Chang Soo Kwak, Daejeon (KR); Man Seok Uhm, Daejeon (KR); In Bok Yom, Daejeon (KR); Hong Yeol Lee, Cheongju-si (KR)

(73) Assignee: Electronics and Telecommunications Research Instit, Daejeon (KR)

( * ) Notice: Subject to any disclaimer, the term of this patent is extended or adjusted under 35 U.S.C. 154(b) by 136 days.

(21) Appl. No.: 14/462,745

(22) Filed: Aug. 19, 2014

(65) Prior Publication Data

US 2015/0349429 A1 Dec. 3, 2015

(30) Foreign Application Priority Data

May 27, 2014 (KR) ..... 10-2014-0063459

(51) Int. Cl.
*H01Q 19/19* (2006.01)
*H01Q 15/16* (2006.01)

(52) U.S. Cl.
CPC ..... *H01Q 15/16* (2013.01); *H01Q 19/19* (2013.01); *H01Q 19/192* (2013.01)

(58) Field of Classification Search
CPC ..... H01Q 15/16; H01Q 19/19; H01Q 19/192
USPC ..... 343/781 R, 781 P, 781 CA, 838, 837, 840
See application file for complete search history.

(56) References Cited

U.S. PATENT DOCUMENTS 3,243,805 A * 3/1966 Smith, Jr. ..... G01S 1/02 342/80
4,298,877 A * 11/1981 Sletten ..... H01Q 1/1264 343/781 CA
5,485,168 A * 1/1996 Parekh ..... H01Q 3/20 343/761
5,546,097 A * 8/1996 Ramanujam ..... H01Q 25/007 343/781 CA
5,959,590 A 9/1999 Sanford et al.
6,020,859 A 2/2000 Kildal
6,107,973 A 8/2000 Knop et al.
6,774,861 B2 * 8/2004 Choung ..... H01Q 19/192 343/781 CA
6,831,613 B1 * 12/2004 Gothard ..... H01Q 13/0266 343/779
7,773,042 B2 8/2010 Yun et al.
2003/0234746 A1 * 12/2003 Tang ..... H01Q 1/288 343/781 CA
2005/0017916 A1 1/2005 Lewry et al.
2011/0241956 A1 10/2011 Byun et al.

OTHER PUBLICATIONS

Fernando J. S. Moreira, Generalized Classical Axially Symmetric Dual-Reflector Antennas, IEEE Transactions on Antennas and Propagation, Apr. 2001, pp. 547-554, vol. 49, No. 4.
Christophe Granet, A Simple Procedure for the Design of Classical Displaced-Axis Dual-Reflector Antennas Using a Set of Geometric Parameters, IEEE Antennas and Propagation Magazine, Dec. 1999, pp. 64-71, vol. 41, No. 6.

* cited by examiner

*Primary Examiner* — Tho G Phan
(74) *Attorney, Agent, or Firm* — William Park & Associates Ltd.

(57) ABSTRACT

The present invention relates to a dual reflector antenna with a hybrid subreflector, and more particularly, to a dual reflector antenna with a subreflector having a structure in which an ellipse and a hyperbola are combined. An exemplary embodiment of the present invention provides a dual reflector antenna including: a main reflector; and a hybrid subreflector which faces the main reflector and has a first structure and a second structure which are combined therein.

13 Claims, 11 Drawing Sheets

| TYPE OF ANTENNA | MAXIMUM GAIN(dB) | REFLECTION LOSS(dB) |
|---|---|---|
| SINGLE ADE | 40.42 | 45.1 |
| SINGLE ADC | 39.55 | 12.5 |
| HYBRID SUBREFLECTOR | 39.80 | 24.5 |

DUAL REFLECTOR ANTENNA WITH HYBRID SUBREFLECTOR

CROSS-REFERENCE TO RELATED APPLICATIONS

This application claims priority to and the benefit of Korean Patent Application No. 10-2014-0063459 filed in the Korean Intellectual Property Office on May 27, 2014, the entire contents of which are incorporated herein by reference.

TECHNICAL FIELD

The present invention relates to a dual reflector antenna with a hybrid subreflector, and more particularly, to a dual reflector antenna with a subreflector having a structure in which an ellipse and a hyperbola are combined.

BACKGROUND ART

An antenna is an essential component to provide communication and broadcasting services and specifically, a dual reflector antenna having high directivity is mainly used thereof. The dual reflector antenna has a structure in which the directivity is improved using a subreflector in addition to a main reflector (parabola).

A subreflector of the dual reflector antenna generally has an elliptical or hyperbolic shape having two focal points. A first focal point which is one of the focal points of the subreflector is coincident with a focal point of a parabolic reflector and a second focal point which is the other focal point is coincident with a phase center of a feeding element.

When a signal flow in a transmitting mode is examined, a signal which starts from a phase center (the second focal point) of the feeding element is reflected from the subreflector to proceed toward the first focal point of the subreflector. This signal proceeds on an aperture of the antenna as an in-phase planar wave. In the receiving mode, contrary to the transmitting mode, the signal which starts as the planar wave passes the first focal point of the subreflector and proceeds to the phase center of the feeding element.

Generally, an antenna which satisfies high directivity and low side lobe level is evaluated to have good performance. Therefore, in order to achieve high directivity, radio wave interference caused by the subreflector needs to be reduced and in order to achieve the low side lobe level, a diffracted wave at a corner of the reflector needs to be reduced.

In the related art, in order to simultaneously satisfy the high directivity and the low side lobe level, the main reflector and the subreflector are simultaneously molded through complex calculation for field distribution or a ray or corrugation is provided on a surface of the subreflector to concentrate the signal and the diffracted signal is reduced through an external choke.

However, according to the related art, complex calculation is necessary or a separate device needs to be added, which results in more cost and time to design an antenna.

SUMMARY OF THE INVENTION

The present invention has been made in an effort to provide a dual reflector antenna in which a subreflector of a dual reflector antenna is formed by combining an ellipsoidal structure and a hyperbolic structure, thereby increasing the directivity and reducing a side lobe level without using complex calculation and providing an additional device.

An exemplary embodiment of the present invention provides a dual reflector antenna including: a main reflector; and a hybrid subreflector which faces the main reflector and has a first structure and a second structure which are combined therein.

The first structure may be an elliptical structure and the second structure may be a hyperbolic structure.

The hybrid subreflector may include a first region which is formed with the second structure at a bottom; a second region which is formed with the first structure in the middle; and a third region which is formed with the second structure at a top.

The hybrid subreflector may have at least two intersecting points between the first structure and the second structure.

The hybrid subreflector may include a first intersecting point which is formed at a point where the first region and the second region intersect; and a second intersecting point which is formed at a point where the second region and the third region intersect.

In the hybrid subreflector, a distance between the first structure and the main reflector may be smaller than a distance between the second structure and the main reflector.

At least two focal points may include a first focal point formed between the main reflector and the hybrid subreflector; and a second focal point which is formed to be opposite to the first focal point with respect to the hybrid subreflector.

The dual reflector antenna may further include a first focal distance between the first focal point and the main reflector which is calculated using the distance between the first structure and the main reflector; and a second focal distance between the second focal point and the main reflector which is calculated using the distance between the second structure and the main reflector.

The main reflector may include a first region which is determined by the second focal point; a second region which is determined by the first focal point; and a third region which is determined by the second focal point.

The main reflector may include a parabolic structure determined by the first focal point and the second focal point.

In the hybrid subreflector, the first structure may be an axially displaced ellipse (ADE) antenna and the second structure may be an axially displaced Cassegrain (ADC) antenna.

In the hybrid subreflector, the first structure may be an axially displaced Gregorian (ADG) antenna and the second structure may be an axially displaced hyperbola (ADH) antenna.

The dual reflector antenna may further include a feeding element which concentrates a signal onto the hybrid subreflector or the main reflector.

According to this technology, when a dual antenna reflector is designed, high directivity and low side lobe level may be achieved without using complex calculation nor requiring an additional device.

Figure 1:
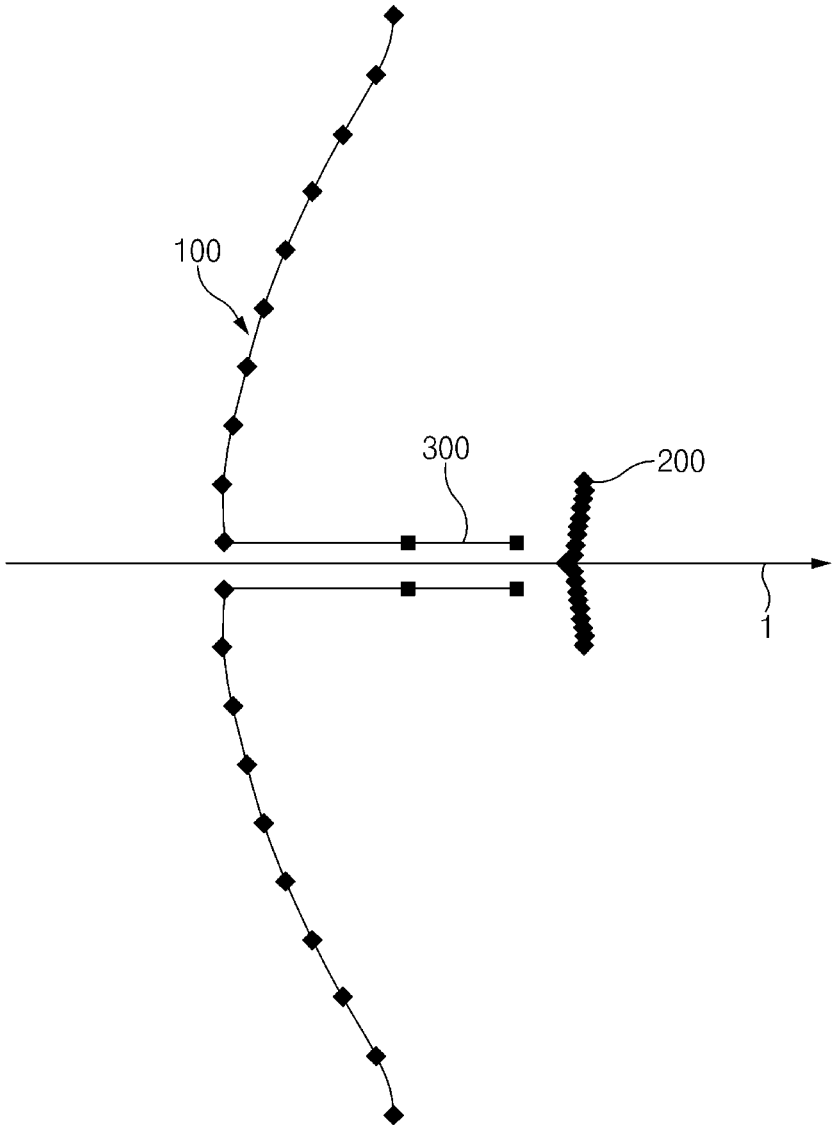
FIG. 1 is a structural diagram of a dual reflector antenna having a hybrid subreflector according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in more detail with reference to the accompanying drawings. Prior to this, terms or words used in the present specification and claims should not be interpreted as being limited to typical or dictionary meanings, but should be interpreted as having meanings and concepts which comply with the technical spirit of the present invention, based on the principle that an inventor can appropriately define the concept of the term to describe his/her own invention in the best manner. Therefore, configurations illustrated in the embodiments and the drawings described in the present specification are only the most preferred embodiment of the present invention and do not represent all of the technical spirit of the present invention, and thus it is to be understood that various equivalents and modified examples, which may replace the configurations, are possible when filing the present application.

The present invention discloses a technology which defines a shape of a subreflector which is used for a dual reflector antenna as a combination of an ellipse and a hyperbola to improve reflection loss, a maximum gain, and a side lobe level property while simplifying a design of a molded reflector and an antenna structure as a technology of designing a dual reflector antenna for achieving high directivity and low side lobe level.

Hereinafter, a structure and characteristic of a dual reflector antenna having a hybrid subreflector according to an exemplary embodiment of the present invention will be described with reference to FIGS. 1 to 7B.

Figure 2:
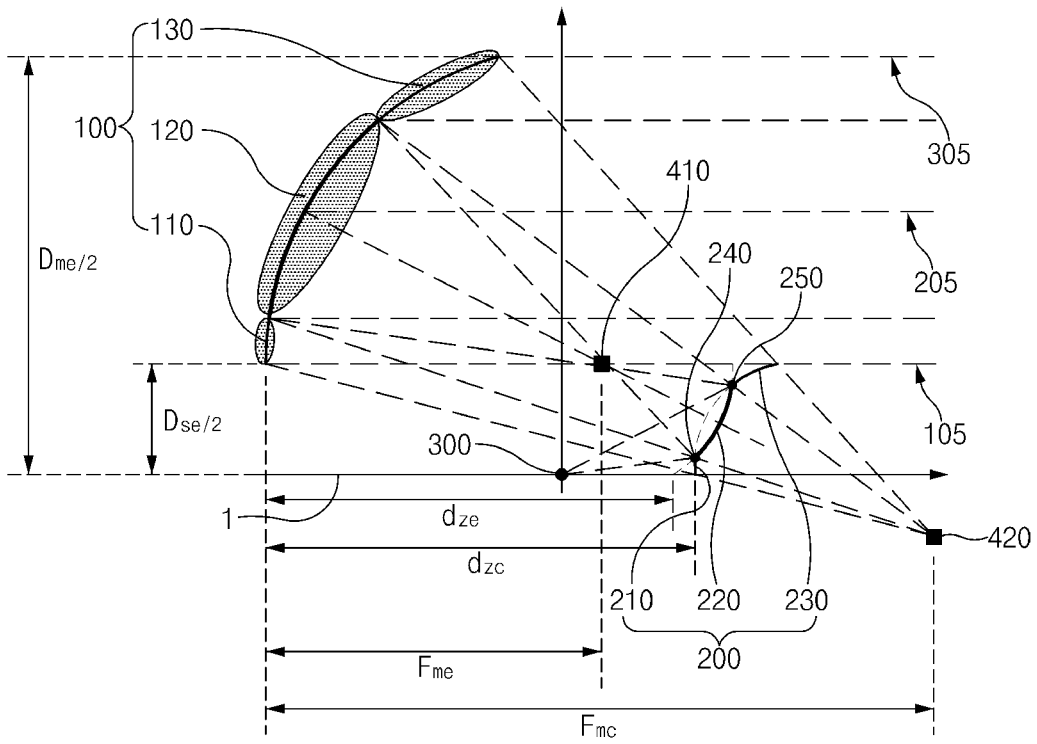
FIG. 2 is a conceptual diagram of a dual reflector antenna having a hybrid subreflector according to an exemplary embodiment of the present invention.

FIG. 1 is a structural diagram of a dual reflector antenna having a hybrid subreflector according to an exemplary embodiment of the present invention and FIG. 2 is a conceptual diagram illustrating a structure of a dual reflector antenna having a hybrid subreflector according to an exemplary embodiment of the present invention. In this case, all dual antennas according to an exemplary embodiment of the present invention have an axial symmetrical pattern and both antennas with respect to a rotational axis 1 are disclosed in FIG. 1 and only an upper antenna with respect to the rotational axis 1 is illustrated in FIG. 2 for the purpose of convenience.

As illustrated in FIGS. 1 and 2, a dual reflector antenna according to an exemplary embodiment of the present invention includes a main reflector 100 and a hybrid subreflector 200 which have two symmetric planes. A feeding element (feeder: 300) is disposed between the main reflector 100 and the hybrid subreflector 200 in order to form a planar wave.

The hybrid subreflector 200 is formed by combination of a hyperbolic structure and an elliptical structure and an axially displaced ellipse (ADE) antenna having an elliptical structure and an axially displaced Cassegrain (ADC) antenna having a hyperbolic structure are combined. Therefore, two intersecting points 240 and 250 at which the ADE antenna and the ADC antenna intersect are formed and the subreflector 200 includes a first region 210 having a hyperbolic structure, a second region 220 having an elliptical structure, and a third region 230 having a hyperbolic structure. In this case, the first region 210 is disposed at a bottom portion of the hybrid subreflector 200, the third region 230 is disposed at a top portion of the hybrid subreflector 200, and the second region 220 is disposed between the first region 210 and the third region 230. The first region 210 of the hybrid subreflector 200 serves as an ADE subreflector, the second region 220 serves as an ADC subreflector, and the third region 230 serves as an ADE subreflector.

A first focal point 410 is formed between the main reflector 100 and the hybrid subreflector 200 and a second focal point 420 is formed at an opposite position to the first focal point 410 with respect to the hybrid subreflector 200.

The main reflector 100 has a single hyperbolic structure but for the convenience of description, in FIG. 2, the main reflector 100 is divided into a first region 110, a second region 120, and a third region 130 corresponding to the first region 210, the second region 220, and the third region 230 of the hybrid subreflector 200 and described. The first region 110 of the main reflector 100 is determined by the second focal point 420, the second region 120 is determined by the first focal point 410, and the third region 130 is determined by the second focal point 420. In other words, a shape of the main reflector 100 is determined by two focal points 410 and 420 by the hybrid subreflector 200 and the main reflector 100 has a shape in which both ends are elevated rather than a simple parabolic structure of the related art as illustrated in FIG. 1.

In FIG. 2, the hybrid subreflector 200 is represented by a solid line and subreflectors which are represented by the dotted line have an ADE or ADC subreflector pattern and some regions thereof are used for the hybrid subreflector 200.

When a concept of a ray is introduced, a signal which starts from the feeding element 300 is reflected onto the ADC subreflector which is the first region 210 of the hybrid subreflector 200 and proceeds toward an aperture (105) after reaching the ADC main reflector which is the first region 110 of the main reflector 100.

The second region 220 of the hybrid subreflector 200 uses a part of the ADE subreflector and a signal of the feeding element 300 is reflected onto the second region 120 of the main reflector 100 after passing through the second region 220 and then proceeds in the form of a ray of the ADE antenna (205).

In the third region 230 of the hybrid subreflector 200, the ray proceeds to the third region 130 of the main reflector 100 using the ADC subreflector and then is reflected (305).

In the meantime, when the hybrid subreflector 200 is formed, the ADE antenna region and the ADC antenna region may be implemented so as to be inversed to each other. That is, the first region 210 of the hybrid subreflector 200 may be implemented as the ADE subreflector, the second region 220 may be implemented as the ADC subreflector, and the third region 230 may be implemented as the ADE subreflector.

Therefore, the ray which starts from the feeding element 300 is reflected onto the ADE which is the first region 210 of the hybrid subreflector 200 and then reaches the third region 130 of the main reflector 100. The ray which reaches the ADC which is the second region 220 of the hybrid subreflector is reflected onto the second region 120 of the main reflector 100. The ray which reaches the ADE which is the third region 230 of the hybrid subreflector 200 is reflected onto an ADE surface of the first region 110 of the main reflector 100 to proceed. The ray characteristic of the antenna in the transmitting mode may also be applied to the receiving mode due to reversibility of the antenna.

In this exemplary embodiment of the present invention, focal distances of the ADC antenna and the ADE antenna are determined using distances $dz_e$ and $dz_c$ between the main reflector 100 and the hybrid subreflector 200 so that an elliptical antenna and a hyperbolic antenna are combined to form a subreflector without having a complicated molding design process or an additional device.

Even though the present invention discloses the exemplary embodiment in which a surface of the hybrid reflector defined in FIG. 2 is formed by sequentially combining a surface of the ADE reflector and a surface of the ADC reflector, the hybrid reflector may also be obtained by sequentially combining a surface of an axially displaced Gregorian (ADG) reflector and a surface of an axially displaced hyperbola (ADH) reflector. The subreflectors of the ADG and ADH antennas use the elliptical and hyperbolic patterns which are the same as those of the ADE and ADC antennas but the subreflector is disposed below the symmetric axis.

Hereinafter, difference of characteristics of a signal subreflector and a hybrid subreflector will be described with reference to FIGS. 3 to 7B.

Figure 3:
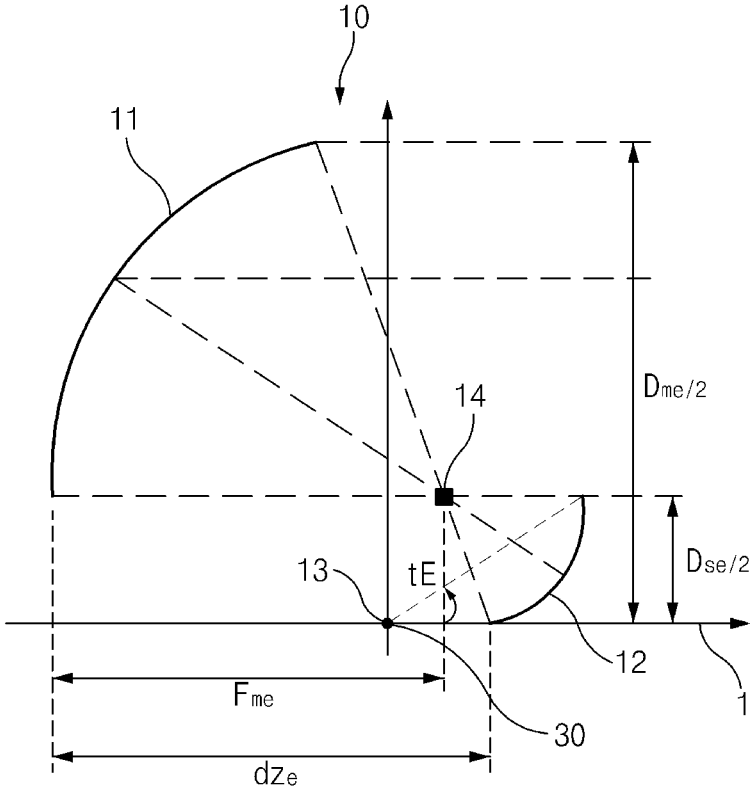
FIG. 3 is a conceptual diagram of an axially displaced ellipse (ADE) antenna for explaining formation of a hybrid subreflector according to an exemplary embodiment of the present invention.

First, FIG. 3 is a conceptual diagram of a single axially displaced ellipse (ADE) antenna for explaining formation of a hybrid subreflector according to an exemplary embodiment of the present invention. A shape parameter of the ADE antenna is as illustrated in FIG. 3 and parameters which determine a shape and an electrical characteristic of the ADE antenna include a size $D_{me}$ and a focal distance $F_{me}$ of the main reflector 11, a size $D_{se}$ of the subreflector 12, and an angle tE formed by the feeding element 30 and an extension of the subreflector 12.

The elliptical subreflector 12 has two focal points 13 and 14 and one focal point 13 is located in the same position as the feeding element 30 and the other focal point 14 is disposed between the main reflector 11 and the subreflector 12.

A large signal at the center of the feeding element 30 is reflected onto a lower corner of the subreflector 12 and then proceeds toward an upper corner of the main reflector 11 so that the ADE antenna 10 generally has aperture efficiency and gain which are larger than those of the ADC antenna.

Figure 4A:
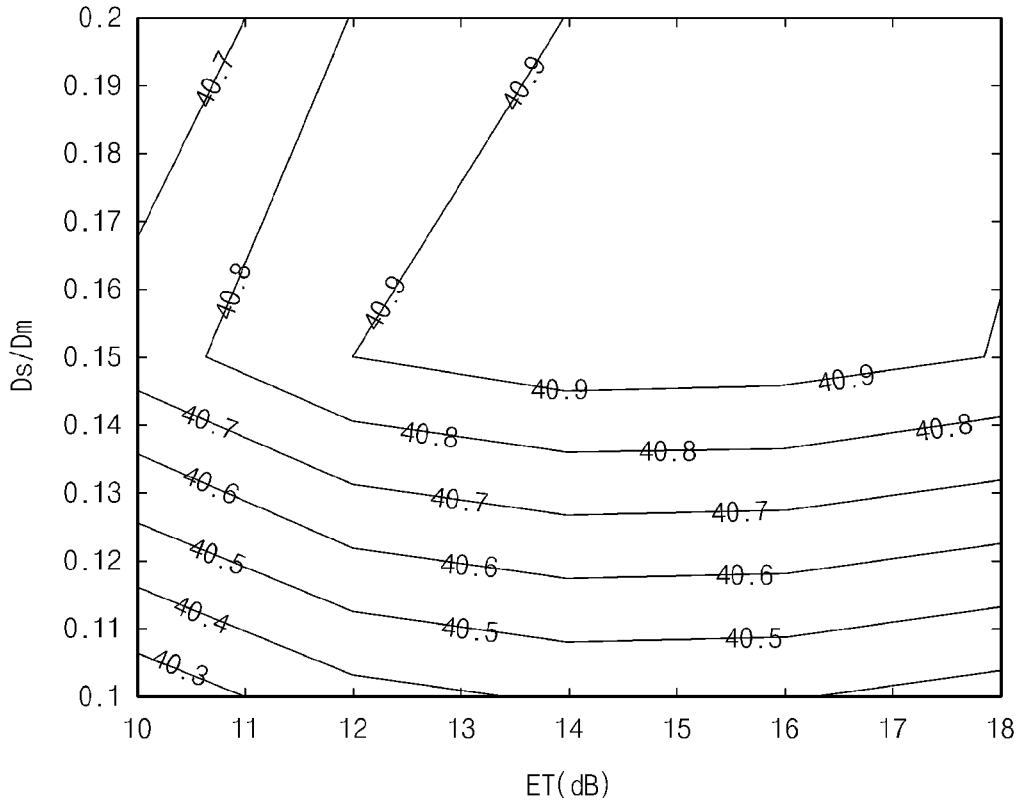
FIG. 4A is a graph illustrating performance of an antenna in accordance with a size ratio of a main reflector and a subreflector of the ADE antenna of FIG. 3.

FIG. 4A is a graph illustrating performance of an antenna in accordance with a size ratio of the main reflector 11 and the single subreflector 12 of the ADE antenna of FIG. 3. That is, FIG. 4A illustrates a maximum gain in accordance with a ratio ($D_{se}/D_{me}$) of a size $D_{se}$ of the subreflector 12 of the ADE antenna 10 and a size $D_{me}$ of the main reflector 11.

Generally, the reflector antenna has best efficiency at an edge taper ET of 11 dB. The ET is an electrical parameter which determines a pattern of the feeding element 13 so that as the ET is increased, the size of the feeding element 13 is increased. Therefore, an appropriate value of the ET needs to be selected in accordance with an environment and a physical condition of the ADE antenna 10. When an ET of the subreflector 12 of the ADE antenna 10 is 0.15 times larger than an ET of the main reflector 11, electrical performance is good. When the ET of the subreflector 12 is 0.15 times smaller than the ET of the main reflector 11, the maximum gain is sensitively lowered in accordance with the change of the size of the subreflector so that a value equal to or larger than 0.15 times needs to be selected.

Figure 4B:
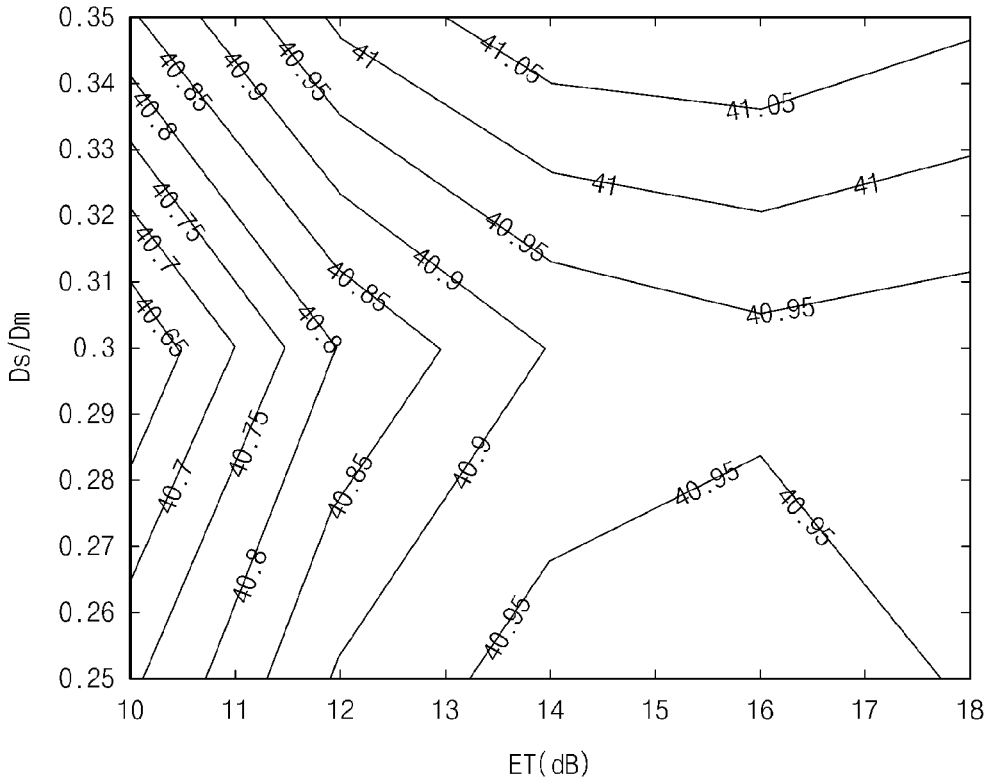
FIG. 4B is a graph illustrating antenna performance in accordance with a ratio between a size of the main reflector and a focal distance of the ADE antenna of FIG. 3.

FIG. 4B is a graph illustrating change of antenna performance in accordance with the focal distance $F_{me}$ of the main reflector of the ADE antenna of FIG. 3 and when a ratio ($F_{me}/D_{me}$) of the focal distance $F_{me}$ and the size $D_{me}$ of the main reflector 11 is 0.3, the worst result may be obtained.

Figure 4C:
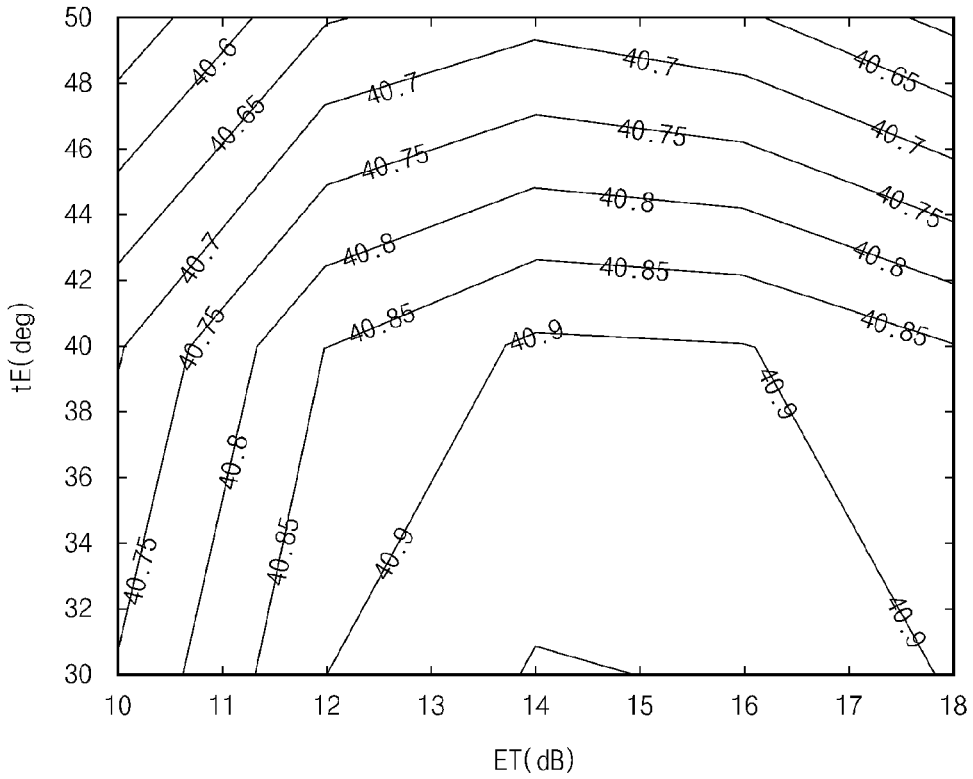
FIG. 4C is a graph illustrating antenna performance in accordance with a semi-angle between the subreflector of the ADE antenna of FIG. 3 and a feeding element.

FIG. 4C shows antenna performance in accordance with a semi-angle tE between an extension of the subreflector 12 of the ADE antenna 10 and the feeding element 13 and the antenna performance becomes better as the semi-angle becomes smaller.

Figure 5:
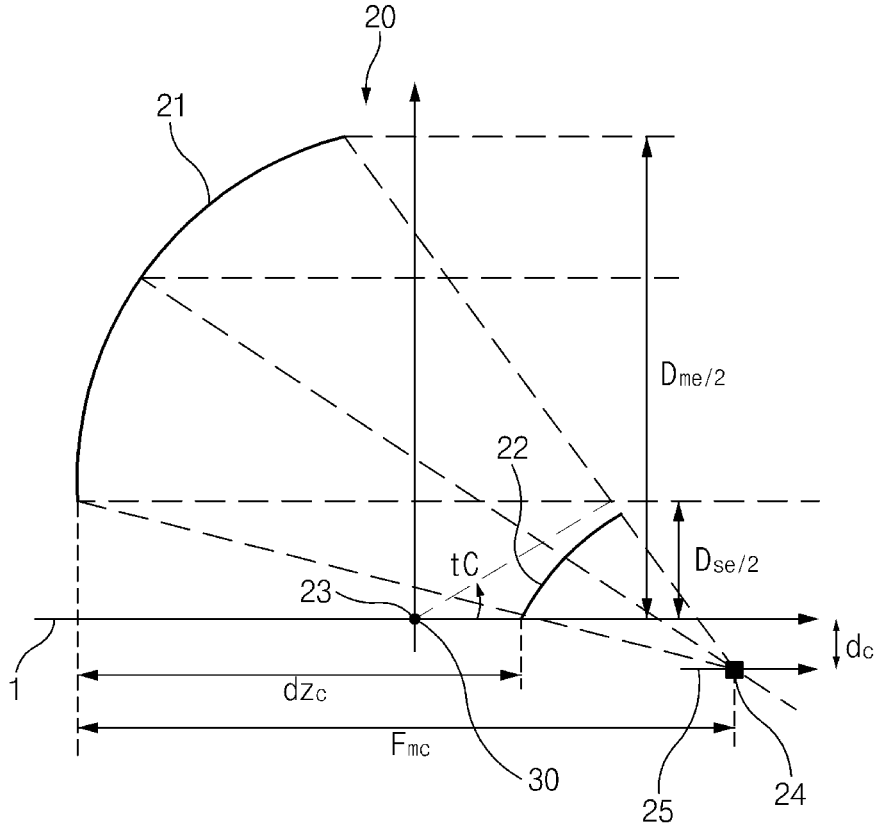
FIG. 5 is a conceptual diagram of an axially displaced Cassegrain (ADC) antenna for explaining formation of a hybrid subreflector according to an exemplary embodiment of the present invention.

FIG. 5 is a conceptual diagram of a single axially displaced Cassegrain (ADC) antenna for explaining formation of a hybrid subreflector according to an exemplary embodiment of the present invention. As illustrated in FIG. 5, differently from the ADE antenna 10 having the elliptical subreflector 12, the ADC antenna 20 has a hyperbolic subreflector 22.

A shape parameter of the ADC antenna is as illustrated in FIG. 5 and parameters which determine a shape and an electric characteristic of the ADC antenna include a size $D_{mc}$ and a focal distance $F_{mc}$ of the main reflector 21, a size $D_{sc}$ of the subreflector 22, and an angle tC formed by the feeding element 30 and an extension of the subreflector 22.

In the case of the hyperbola having two focal points 23 and 24, one focal point 23 is located at the same position as the feeding element 30 and the other focal point 24 is located at an extension of the corner of the main/subreflector 21 and 22. Therefore, the focal distance $F_{mc}$ of the main reflector of the ADC antenna 20 is longer than the focal distance $F_{me}$ of the main reflector of the ADE antenna 10. A large signal at the center which starts from the feeding element 30 passes the lower corner of the subreflector 22 and then proceeds toward the lower corner of the main reflector 21 so that the ADC antenna 20 is largely affected by a pattern which is directly radiated from the feeding element 30.

Figure 6A:
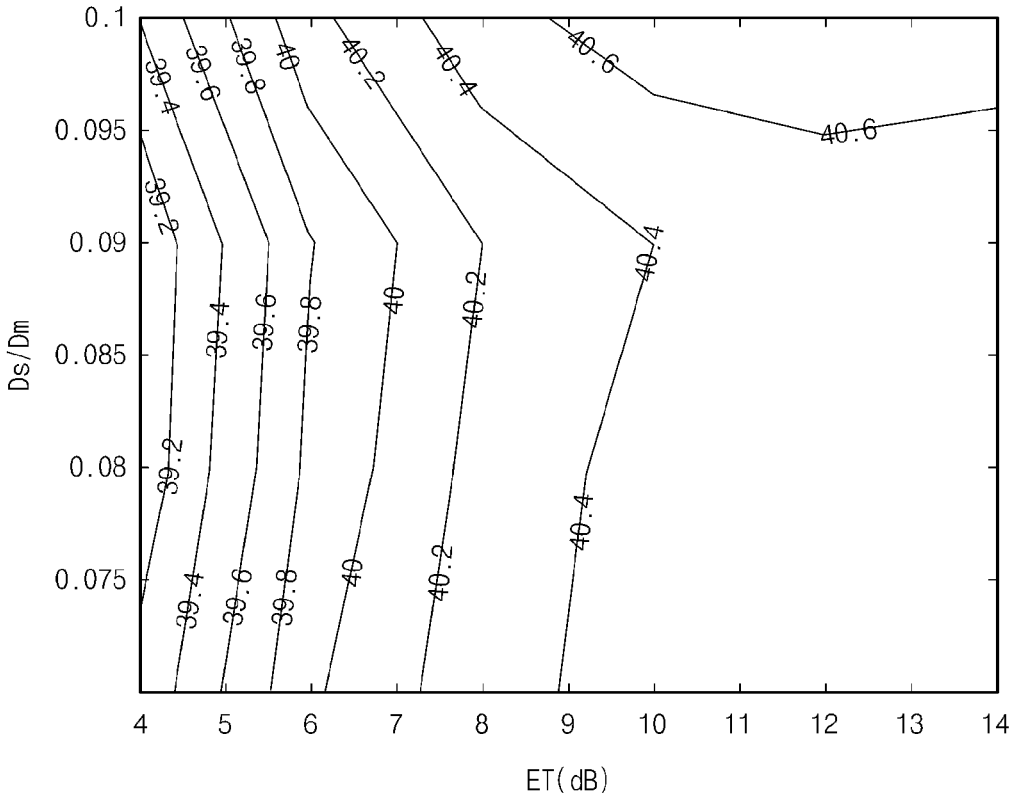
FIG. 6A is a graph illustrating performance of an antenna in accordance with a size ratio of a main reflector and a subreflector of the ADC antenna of FIG. 5.

FIG. 6A shows an antenna characteristic in accordance with the size $D_{mc}$ of the subreflector 22 of the ADC antenna 20. When the ADC antenna 20 is designed, the ET is increased and a ratio ($D_{sc}/D_{mc}$) of the sizes of the main reflector and the subreflector is equal to or larger than 0.09.

Figure 6B:
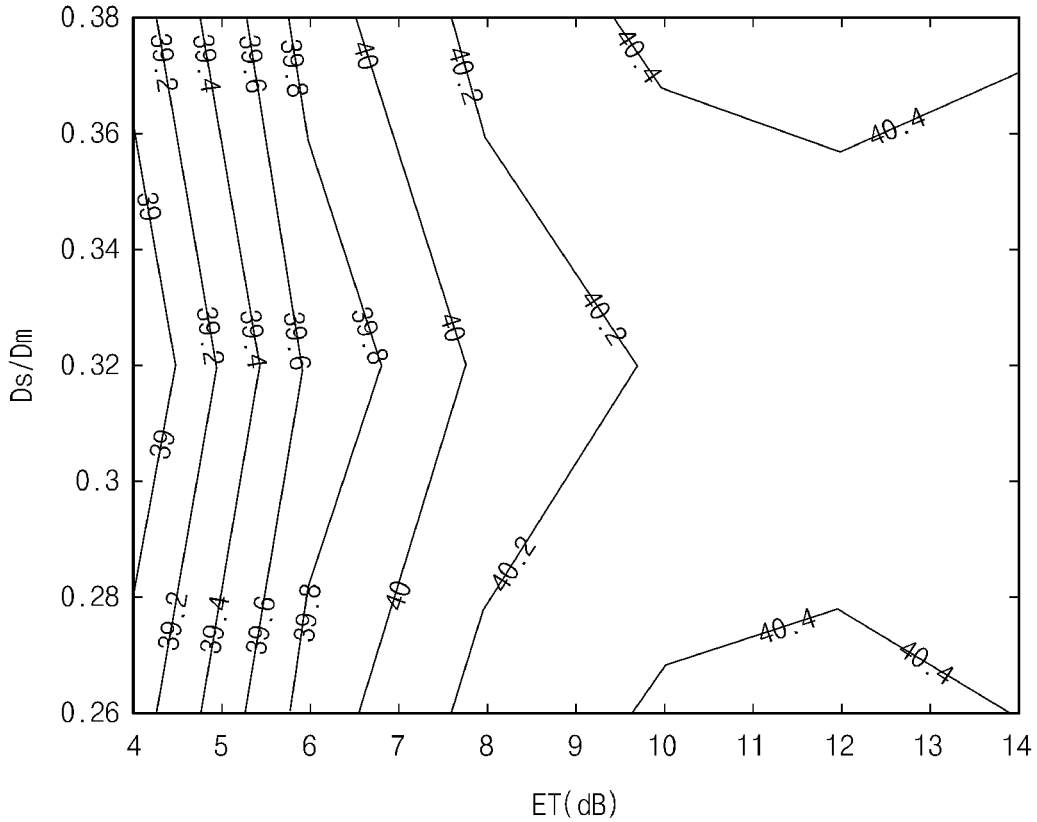
FIG. 6B is a graph illustrating antenna performance in accordance with a ratio between a size of the main reflector and a focal distance of the ADC antenna of FIG. 5.
Figure 6C:
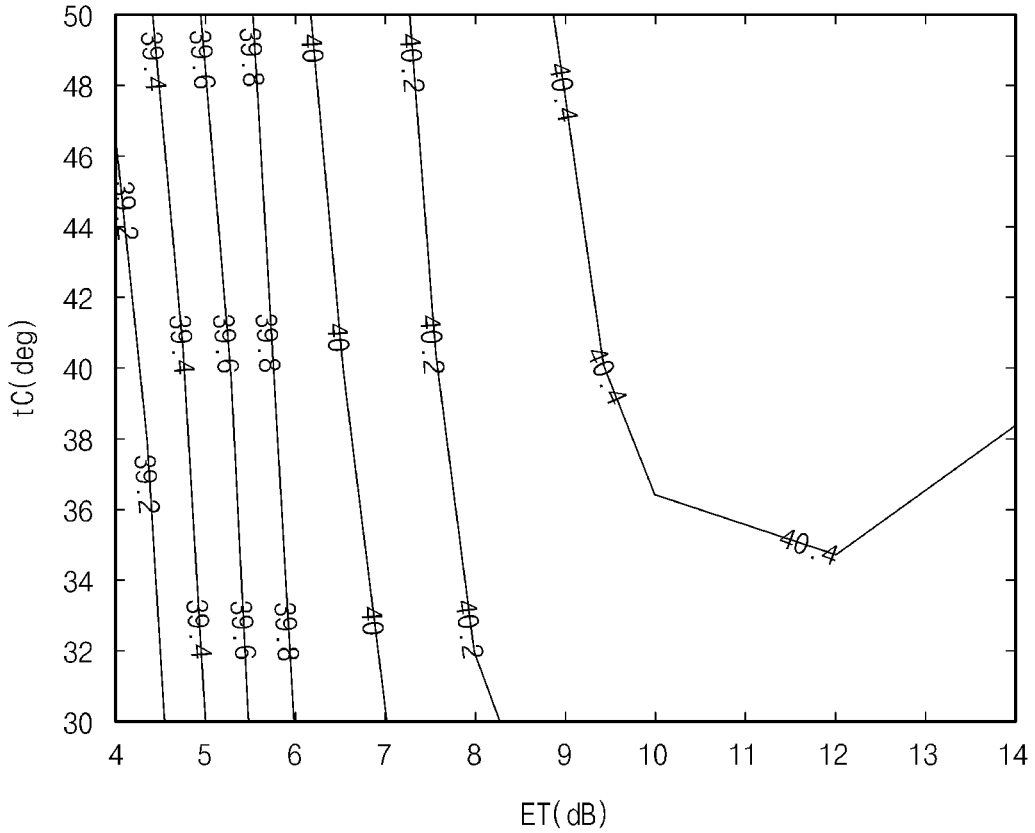
FIG. 6C is a graph illustrating antenna performance in accordance with a semi-angle between the subreflector and a feeding element of the ADC antenna of FIG. 5.

Referring to FIG. 6B, the focal distance $F_{mc}$ of the main reflector of the ADC antenna 20 is designed so as not to be 0.32 times of the size $D_{mc}$ of the main reflector. As illustrated in FIG. 6C, the semi-angle tC between the extension of the ADC subreflector 22 and the feeding element 30 does not largely affect the change of the performance.

Therefore, according to the exemplary embodiment of the present invention, the ADE antenna and the ADC antenna are mixed in consideration with the electrical characteristic so that an effect of the molded reflector may be obtained without using a complex equation or having an additional device.

That is, in order to combine the ADE antenna and the ADC antenna, the following Equation 1 and Equation 2 may be utilized such that two antennas have one molded reflector shape while sharing the main reflector.

$$dZ_e = F_{me} + \frac{F_{me}D_{se}}{D_{me} - D_{se}} - \frac{D_{se}(D_{me} - D_{se})}{16F_{me}} \quad \text{[Equation 1]}$$

$$dZ_c = \frac{16F_{mc} - (D_{sc} + 2d_c)^2}{16F_{mc}} - \frac{d(16F_{mc}^2 + (D_{sc} + 2d_c)^2)}{8F_{mc}(D_{sc} + 2d_c)}\cos\delta \quad \text{[Equation 2]}$$

In the following Equation 3, a value of is defined.

$$\delta = \tan^{-1}\left(\frac{8F_{mc}(D_{sc} + 2d_c)}{16F_{mc}^2 - (D_{sc} + 2d_c)^2}\right) \quad \text{[Equation 3]}$$

Equation 1 is an equation which calculates a distance $dz_e$ between the main reflector and the subreflector of the ADE antenna and Equation 2 is an equation which calculates a distance $dz_c$ between the main reflector and the subreflector of the ADC antenna.

In Equation 1 and Equation 2, the form parameters of the sizes $D_{me}$ and $D_{mc}$ of the main reflectors, the focal distances $F_{me}$ and $F_{mc}$ of the main reflectors, the sizes $D_{se}$ and $D_{sc}$ of the subreflectors and a distance $d_c$ between an axis of the main reflector and the rotational axis are used. In this case, the distance $d_c$ between the axis 25 of the main reflector and the rotational axis 1 illustrated in FIG. 5 is a parameter only in the ADC, ADG, and ADH types. In the exemplary embodiment of the present invention, a condition required to configure a new one antenna by combining two antennas is $dz_e<dz_c$. That is, the distance $dz_c$ between the main reflector and the subreflector of the ADE antenna needs to be smaller than the distance $dz_c$ between the main reflector and the subreflector of the ADC antenna.

In this case, the semi-angles tE and tC between the extensions of the subreflectors of the antennas and the feeding element are not used to calculate the $dz_e$ and $dz_c$ but used to determine an intersecting range of the two antennas and the semi-angles need to satisfy the relationship of tE>tC.

For example, a method of forming a hybrid reflector by calculating focal distances $F_{me}$ and $F_{mc}$ of the main reflectors using the above-described Equation 1 and Equation 2 will be described.

In order to perform electrical analysis of the reflector antenna, the feeding element 300 uses a circular waveguide form and a radiation pattern of the ADE antenna by a circular waveguide having a TE11 mode in consideration of a cutoff frequency characteristic and a radiation pattern of the ADC antenna by the same waveguide are analyzed.

In this case, it is assumed that the sizes of the main reflector and the subreflector are the same and when the focal distance is calculated using Equation 1 and Equation 2 such that the distance $dz_e$ between the main reflector and the subreflector of the ADE antenna is 204 mm and the distance $dz_c$ between the main reflector and the subreflector of the ADC antenna is 230 mm, the focal distance $F_{me}$ of the ADE antenna is determined to be 189 mm and the focal distance $F_{mc}$ of the ADC antenna is determined to be 237 mm.

Therefore, the hybrid subreflector 200 is designed so that the focal point is formed in the focal distance $F_{me}$ of the ADE antenna and the focal distance $F_{mc}$ of the ADC antenna calculated as described above.

Figures 7A, 7B:
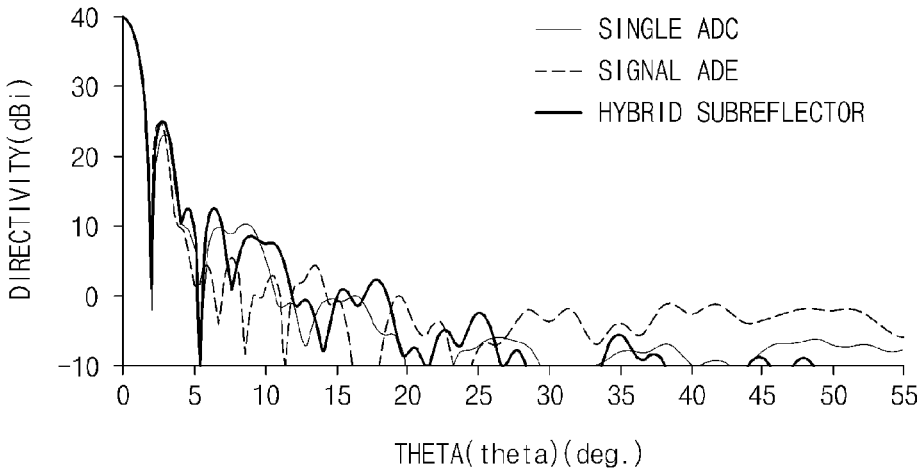
FIG. 7A is a graph which compares directivity of a hybrid subreflector according to an exemplary embodiment of the present invention with directivity of a signal subreflector.
FIG. 7B is a table which compares a maximum gain and reflection loss of the hybrid subreflector according to an exemplary embodiment of the present invention with those of the single subreflector.

As illustrated in FIGS. 7A and 7B, the single ADE antenna has an electrically opposite characteristic to the single ADC antenna. The ADE antenna has characteristics of a high gain and an excellent reflection loss and a bad side lobe level characteristic in a long distance region (30 theta or longer). International standards and rules require −10 dB or less of a side lobe level in a long distance region. In contrast, the ADC antenna has a good side lobe level characteristic in the long distance region but needs to improve characteristics of the gain and the reflection loss as illustrated in FIG. 7B.

Therefore, in the exemplary embodiment of the present invention, the subreflector is formed by combining the ADE antenna and the ADC antenna so that an electrical weakness of the ADE antenna and the ADC antenna may be supplemented. As illustrated in FIGS. 7A and 7B, in the case of the hybrid subreflector, as a result, the characteristics of the maximum gain and the reflection loss of the ADC antenna are improved and the long distance side lobe characteristic of the ADE antenna is improved.

As described above, differently from the related art which improves the performance by a complex molded reflector designing process or an addition component, according to the present invention, the ellipse and the hyperbola are combined to form a subreflector so that the directivity of the antenna is increased and the side lobe level is reduced, thereby simplifying a molding process and reducing the cost and also reducing a tolerance generated when the antenna is manufactured so that more stable antenna characteristics may be obtained.

While the exemplary embodiments of the present invention have been described for illustrative purposes, it should be understood by those skilled in the art that various changes, modifications, substitutions, and additions may be made without departing from the spirit and scope of the present invention as defined in the appended claims and such changes and modification belong to the following claims.

What is claimed is:

1. A dual reflector antenna having a hybrid subreflector, comprising:

a main reflector; and a hybrid subreflector which faces the main reflector and has a first structure and a second structure which are combined therein, wherein the hybrid subreflector is a single structure in which the first structure and the second structure are combined to form the single structure.

2. The dual reflector antenna of claim 1, wherein the first structure is an elliptical structure and the second structure is a hyperbolic structure.

3. The dual reflector antenna of claim 1, wherein the hybrid subreflector includes:

a first region which is formed with the second structure at a bottom;

a second region which is formed with the first structure in the middle; and a third region which is formed with the second structure at a top.

4. The dual reflector antenna of claim 1, wherein the hybrid subreflector has at least two intersecting points between the first structure and the second structure.

5. The dual reflector antenna of claim 1, wherein the hybrid subreflector includes:

a first intersecting point which is formed at a point where a first region and a second region intersect; and a second intersecting point which is formed at a point where the second region and a third region intersect.

6. The dual reflector antenna of claim 5, wherein the at least two focal points include:

a first focal point formed between the main reflector and the hybrid subreflector; and a second focal point which is formed to be opposite to the first focal point with respect to the hybrid subreflector.

7. The dual reflector antenna of claim 6, further comprising:

a first focal distance between the first focal point and the main reflector which is calculated using the distance between the first structure and the main reflector; and a second focal distance between the second focal point and the main reflector which is calculated using the distance between the second structure and the main reflector.

8. The dual reflector antenna of claim 6, wherein the main reflector includes:

the first region which is determined by the second focal point;

the second region which is determined by the first focal point; and the third region which is determined by the second focal point.

9. The dual reflector antenna of claim 6, wherein the main reflector has a parabolic structure determined by the first focal point and the second focal point.

10. The dual reflector antenna of claim 1, wherein in the hybrid subreflector, a distance between the first structure and the main reflector is smaller than a distance between the second structure and the main reflector.

11. The dual reflector antenna of claim 1, wherein in the hybrid subreflector, the first structure is an axially displaced ellipse (ADE) antenna and the second structure is an axially displaced Cassegrain (ADC) antenna.

12. The dual reflector antenna of claim 1, wherein in the hybrid subreflector, the first structure is an axially displaced Gregorian (ADG) antenna and the second structure is an axially displaced hyperbola (ADH) antenna.

13. The dual reflector antenna of claim 1, further comprising:

a feeding element which concentrates a signal onto the hybrid subreflector or the main reflector.

* * * * *